US007232056B1

(12) United States Patent
Jackson

(10) Patent No.: US 7,232,056 B1
(45) Date of Patent: Jun. 19, 2007

(54) SECURE MAILBOX

(76) Inventor: Lee E. Jackson, 264 W. 12th St., Elmira Heights, NY (US) 14903

( * ) Notice: Subject to any disclaimer, the term of this patent is extended or adjusted under 35 U.S.C. 154(b) by 292 days.

(21) Appl. No.: 10/991,280

(22) Filed: Nov. 18, 2004

(51) Int. Cl.
*B65G 11/04* (2006.01)

(52) U.S. Cl. ..... 232/52; 232/47; 232/35

(58) Field of Classification Search ..... 232/47, 232/52, 45, 17, 34, 35
See application file for complete search history.

(56) References Cited

U.S. PATENT DOCUMENTS

| | | | | | |
|---|---|---|---|---|---|
| 147,445 | A | * | 2/1874 | Stewart | 232/47 |
| 427,464 | A | * | 5/1890 | Darrach | 232/47 |
| 516,890 | A | * | 3/1894 | Hentz | 232/35 |
| 572,893 | A | * | 12/1896 | Hentz | 232/30 |
| 660,706 | A | * | 10/1900 | Knight | 232/47 |
| 3,519,198 | A | * | 7/1970 | Benoliel | 232/17 |
| 3,735,919 | A | * | 5/1973 | Morgan | 232/17 |
| 3,802,619 | A | | 4/1974 | Vanderveer | |
| 4,382,540 | A | | 5/1983 | Kelly et al. | |
| 4,815,656 | A | | 3/1989 | Smith et al. | |
| 5,586,718 | A | | 12/1996 | Speece | |
| 5,915,618 | A | | 6/1999 | Gaudet | |
| 5,938,113 | A | * | 8/1999 | Kim | 232/47 |
| 5,979,751 | A | | 11/1999 | Maddox | |
| 6,234,388 | B1 | | 5/2001 | Taylor | |
| 6,299,061 | B1 | * | 10/2001 | Henson | 232/47 |
| 6,375,071 | B1 | * | 4/2002 | Kim | 232/47 |
| 6,655,577 | B2 | * | 12/2003 | Mihaylov et al. | 232/45 |

* cited by examiner

*Primary Examiner*—William L. Miller
(74) *Attorney, Agent, or Firm*—Mark Levy & Associates, PLLC; David L. Banner

(57) ABSTRACT

There is provided a security mailbox for receiving mail and securely retaining the mail until removed by the mailbox owner. Outgoing mail may be placed in the mailbox and retained out of sight until accessed by the mail carrier. A visual indicator is provided to signal the presence of outgoing mail. Once mail has been deposited in the mailbox and secured within, additional mail may not be placed in the mailbox until the mailbox owner has unlocked and reset the mailbox. Another visual indicator signals the mailbox owner that mail has been deposited in the mailbox. The mailbox is sized to receive small packages such as boxes of checks from a check printer, packages of medications, and the like.

15 Claims, 9 Drawing Sheets

SECURE MAILBOX

FIELD OF THE INVENTION

This invention pertains to mailboxes for receiving mail and, more particularly to a secure mailbox from which mail cannot be removed except by the owner and into which additional mail may not be placed until mail within has been removed and the mailbox reset.

BACKGROUND OF THE INVENTION

Mail security has become increasingly important in a society where fraud is rampant and identity theft is commonplace. Theft of checks and other valuables from delivered mail is not uncommon, particularly in many urban areas. Customers of the United States Postal Service, for example, routinely receive deliveries of blank checks, credit cards, government checks (e.g., Social Security checks), as well as other material having monetary worth or which may be useful in perpetrating fraud in one way or another.

Heretofore, there has been little to protect the recipient of mail from criminals or other mischievous persons intent on stealing or otherwise tampering with delivered mail.

DISCUSSION OF THE PRIOR ART

Several attempts have heretofore been made to prevent such occurrences. None, however, provides the advantages of an entirely secure mailbox. For example, U.S. Pat. No. 3,802,619 for THEFT RESISTANT MAILBOX WITH FLAG, issued Apr. 9, 1974 to Frederick B. Vanderveer, discloses a mailbox having a pivoting door which prevents removal of mail deposited therein. An outgoing mail shelf with an outgoing mail signal is also provided. Contents deposited in the mailbox may be removed by unlocking an access door.

U.S. Pat. No. 4,382,540 for DOUBLE-DOOR SECURITY RURAL MAIL-BOX, issued May 10, 1983 to James B. Kelly et al., teaches a double-door arrangement in a rural mailbox. A front door disposed to accept mail may be freely opened and closed until finally secured in a locked position. A locked, rear door is disposed to retrieve mail from the mailbox. The front door, once locked, is not unlocked until the rear door has been unlocked and opened to retrieve the box contents.

U.S. Pat. No. 4,815,656 for RURAL MAILBOX INDICATOR AND SECURITY LOCK, issued Mar. 28, 1989 to David A. Smith et al., teaches a mailbox having a three-position indicator that alerts the user of one of three conditions, respectively: 1) the mailbox is unlocked and there is no outgoing mail to be picked up; 2) the mailbox is unlocked and there is outgoing mail to be picked up; and 3) the mailbox is locked. When in the third position, the mailbox may not be reopened until the locking mechanism is released by a key.

U.S. Pat. No. 5,586,718 for SECURITY MAILBOX LOCK ASSEMBLY, issued Dec. 24, 1996 to Stephen A. Speece, teaches an add-on lock assembly for rural style mailboxes. The SPEECE arrangement provides a mechanism where the mailbox is unlocked until opened by a letter carrier depositing mail. Closing the door activates the lock, thereby preventing additional access until the mailbox is unlocked with a key.

U.S. Pat. No. 5,915,618 for ANTI-THEFT MAILBOX INSERT, issued Jun. 29, 1999 to Alan P. Gaudet, teaches an apparatus for insertion in a standard rural style mailbox. The GAUDET insert features a locked inner door in a box structure having a slot through which mail may be deposited. The top surface of the insert serves as a shelf to hold outgoing mail for pickup.

U.S. Pat. No. 5,979,751 for ROTATING MAILBOX SYSTEM, issued Nov. 9, 1999 to Joseph Y. Maddox, discloses a mailbox having a rotating assembly which, in combination with a ratchet, transfers incoming mail deposited through an upper access door into a lower chamber and prevents removal of mail deposited through the upper access door. A lower, locked access door is provided for removing mail from the mailbox. In one embodiment, a switch indicates that mail has been deposited in the mailbox. A signal flag is provided to indicate to a mail carrier that outgoing mail requires pickup.

U.S. Pat. No. 6,234,388 for SECURITY MAILBOX, issued May 22, 2001 to Gary L. Taylor, teaches another security mailbox having an incoming chamber separated from a secured chamber by a pivoting rocker plate. Mail is removed from the secured chamber using a lockable door located in a lower region of the secured chamber.

None of these prior art patents teaches or suggests, individually or in combination, an innovative secure mailbox as described hereinbelow.

SUMMARY OF THE INVENTION

The present invention provides a mailbox for receiving mail and securely retaining the mail until removed by the mailbox owner or other authorized person. Outgoing mail may be placed in the mailbox and retained out of sight until accessed by the mail carrier. A visual indicator is provided to indicate the presence of outgoing mail. Once mail has been deposited in the mailbox of the invention and is moved to a secure chamber, additional mail may not be placed in the mailbox until the mailbox owner has unlocked and reset the mailbox. Another visual indicator signals the mailbox owner that mail has been deposited in the mailbox. The mailbox is sized to receive and securely retain small packages such as boxes of checks from a check printer, packages of medications, and the like.

It is, therefore, an object of the invention to provide a secure mailbox for receiving and retaining letters and small packages.

It is another object of the invention to provide a secure mailbox which securely retains outgoing mail until picked up by a letter carrier.

It is a further object of the invention to provide a secure mailbox into which mail has been deposited and which must be reset before additional mail or packages may be deposited therein.

It is an additional object of the invention to provide a secure mailbox having an external, visual indication that mail has been placed in the mailbox.

It is a still further object of the invention to provide a secure mailbox with a visual signal to a letter carrier that outgoing mail requiring pickup is present in the mailbox.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the FIGURES.

DESCRIPTION OF THE PREFERRED EMBODIMENT

Figure 1:
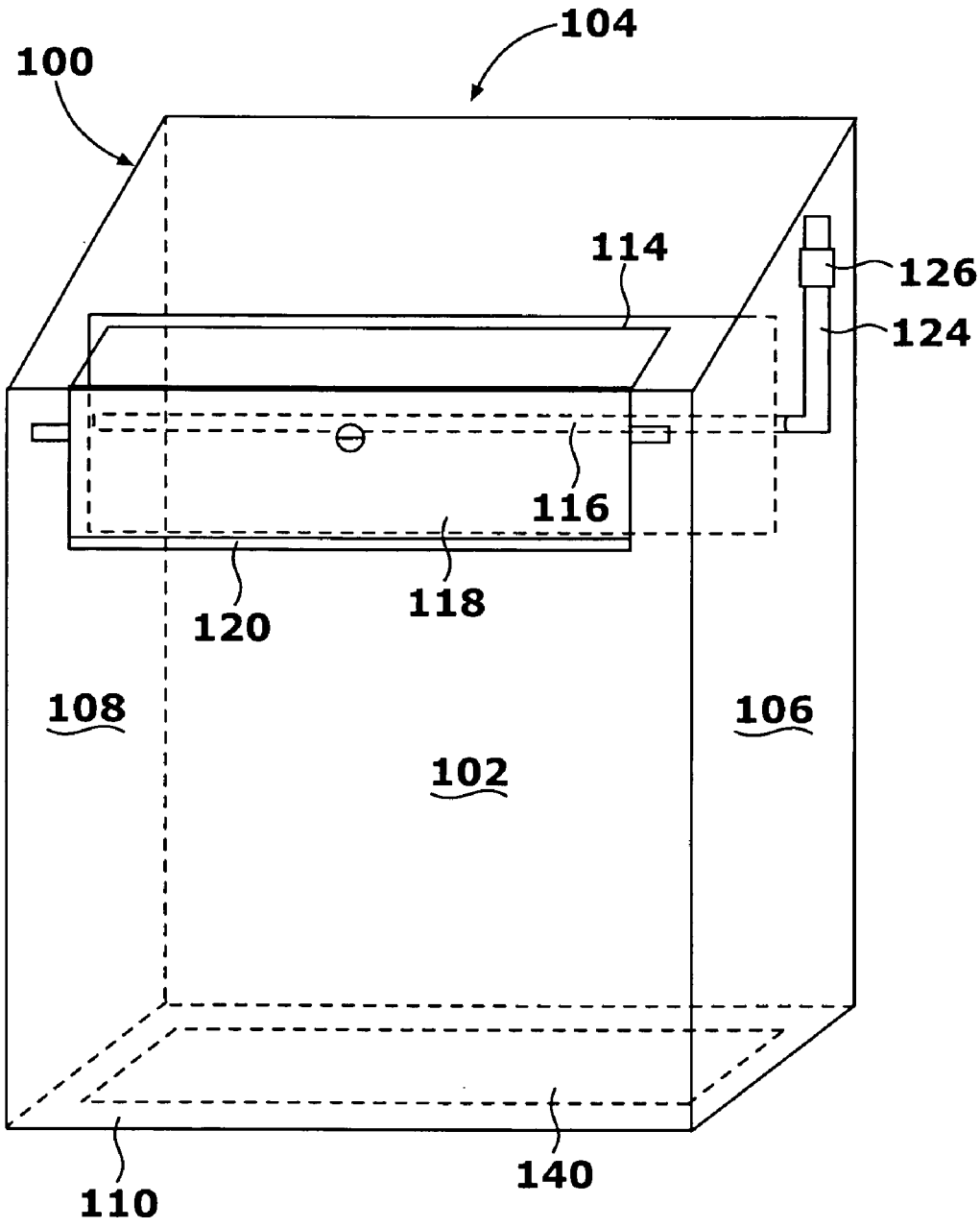
FIG. 1 is a front, perspective view of the mailbox of the invention.

Referring first to FIG. 1, there is shown a front, perspective view of the security mailbox of the invention, generally at reference number 100. Mailbox 100 has a substantially trapezoidal form, when viewed from either side, and consists of substantially rectangular front and rear surfaces 102, 104, respectively, and trapezoidal right and left sides 106, 108, respectively. A bottom 110 is provided with a plurality of "weepage" or drainage holes 112 to allow drainage of any moisture, not shown, which may collect in mailbox 100. Drainage holes 112 are sized small enough to effectively prevent tampering with the contents of mailbox 100 by inserting an object therethrough into mailbox 100 but large enough to allow draining of any moisture either seeping into or condensing in mailbox 100 to drain. While only three holes 112 are shown in FIG. 1, it will be recognized that any number of holes 112 may be provided, the exact number forming no part of the invention.

Figure 1A:
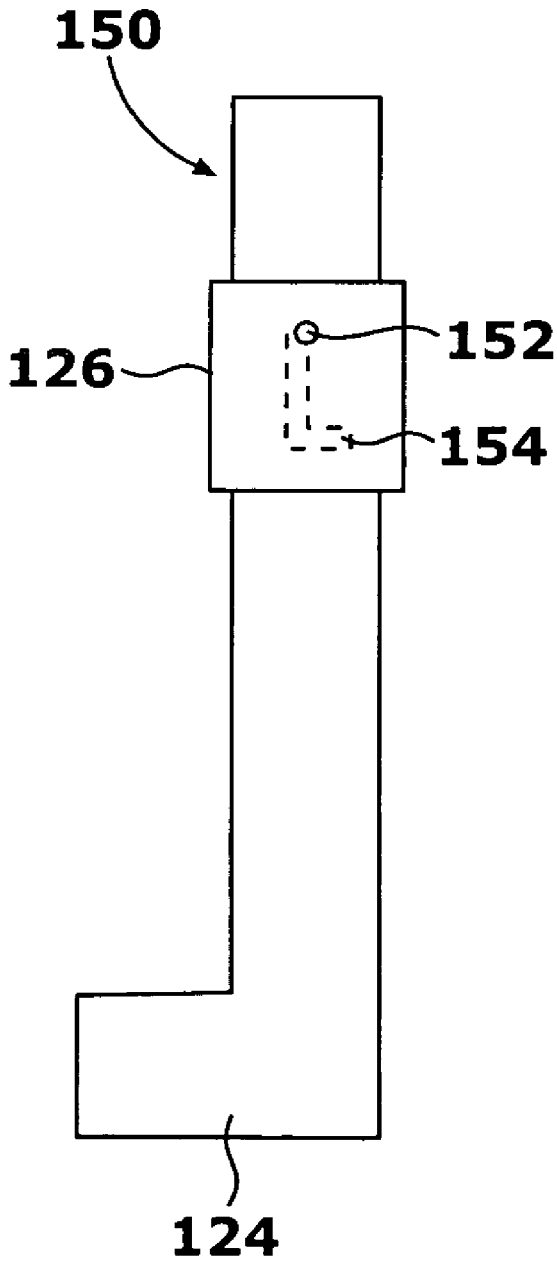

A rotating ledge 114 is secured to an axle 116 which is suitably journaled at sides 106, 108 so as to rotate. Preferably, axle 116 is secured in any type of bearing, not shown, affixed to respective inner surfaces of sides 106, 108. A portion of axle 116 protrudes through right side 106. An indicator arm 124 is attached to the protruding end of axle 116. A sliding sleeve 126 surrounds a portion of indicator arm 124. Referring now also to FIG. 1*a*, there is shown a detailed view of the distal portion of indicator arm 124. A tip portion 150 of indicator arm 124 (i.e., that portion coverable by sliding sleeve 126) is typically painted red. Consequently, when sliding sleeve 126 is moved away from the distal end of indicator arm 124, the red tip is exposed and readily visible to a postal carrier. A red flag or other such indicator has historically been used to signal the mail carrier that there is outgoing mail in the mailbox requiring pickup. A nib 152 in indicator arm 124 interacting with a an L-shaped groove 154 in sliding sleeve 126 is used to retain sliding sleeve 126 in one of two positions along indicator arm 124. In a covering position, red tip portion 150 of indicator arm 124 is covered while in a lower, uncovered position, red portion 150 is exposed as serves as a flag to the postal carrier. It will be recognized that while red has been chosen as a color for tip portion 150 of indicator arm 124 in the embodiment chosen for purposes of disclosure, other colors may be chosen as well. In addition, it will be recognized that other mechanisms are both known and suitable for retaining sliding sleeve 126 on indicator arm 124 and the invention is not considered limited to that mechanism chosen for purposes of disclosure.

As is described in detail hereinbelow, indicator arm 124 is used to determine whether mail has been placed in mailbox 100. While axle 116 could also penetrate left side 108, it is preferable that it be contained within mailbox 100 for both weatherproofing and security reasons. Suitable bearings or journals, not shown, are well known to those of skill in the art and are not further described herein. Such journals or bearings may be affixed to sides 106, 108 using any suitable means including, but not limited to adhesive, spot welding, machine screws, rivets, etc. It is important that no matter what fastening method is used, the axle 116, front surface 102, rear surface 104, sides 106, 108 and bottom 110 are secure and not easily disabled. If the mailbox 100 is disabled, the security function of rotatable platform 114 may possibly be overcome (i.e., moved out of its normal position), thereby crippling its ability to prevent access to a lower portion of the interior of mailbox 100.

A door 118, having a hinge 120 at the lower edge thereof, covers an opening in front surface 102 of mailbox 100. Door 118 has an inwardly projecting lip 128 (best seen in FIG. 4) that protrudes into the interior cavity of mailbox 100 when door 118 is in a closed position (i.e., is flush against front surface 102 of mailbox 100). Lip 128 is sized and configured to serve as a stop for rotatable platform 114 when door 118 is closed. Lip 128 may be formed from an angle bracket suitably affixed to an inside surface of door 118. In other embodiments, lip 128 may be formed as a part of door 118. A lock 122 is provided to secure door 118 in a closed position. Lock 122 may be any suitable lock as is well known to those of skill in the art, the exact lock configuration forming no part of the instant invention.

Figure 2:
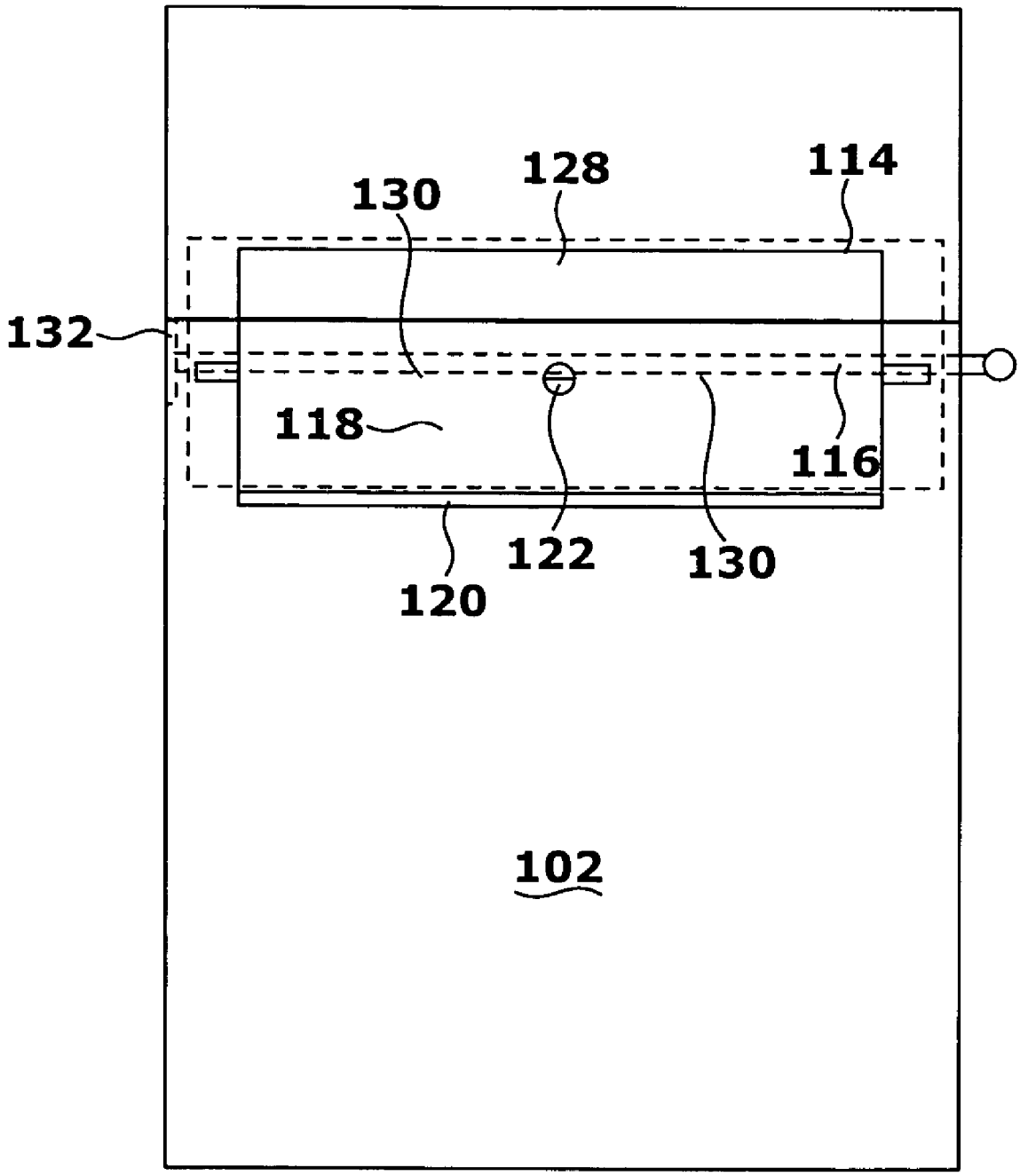
FIG. 2 is a front, elevational view of the mailbox of FIG. 1.
Figure 3:
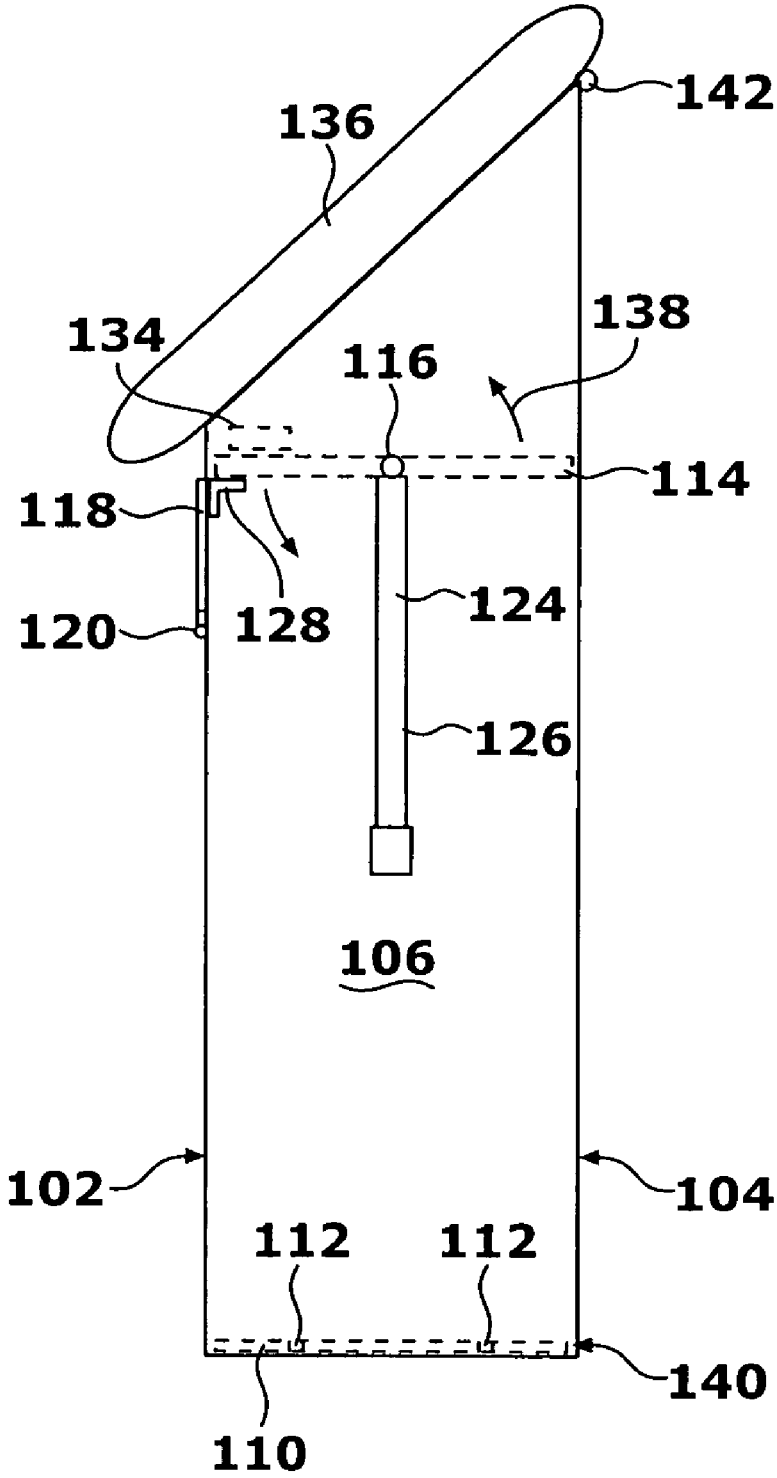
FIG. 3 is a right side, elevational view of the mailbox of FIG. 1.

Referring now also to FIG. 2, there is shown a front elevational view of mailbox 100 in a ready for mail delivery configuration. Portions of a latch 130 associated with a lock 122 is also visible. Finally, a ratchet gear (i.e., toothed wheel) 132 may be seem (in phantom) at the left end of axle 116 Ratchet mechanism 132 is preferably a small, self contained apparatus. In alternate embodiments of the mailbox 100 of the invention, ratchet mechanisms 132 may be positioned at both ends of axel 116. Referring now to FIG. 3, there is shown a right side elevational view of mailbox 100. A raised mesh platform 140 is disposed above an inside surface of bottom 110. Platform 140 is adapted to elevate deposited mail, not shown, above any standing moisture, such as condensation, which may have collected in mailbox 100 and not drained through holes 112. It will be recognized that any perforated or solid material or structure that raises deposited mail above bottom 110 may be used to accomplish the intended purpose; the invention is not considered limited to a particular structure or material. It will be recognized that a solid platform is advantageous in that a wire or similar object pushed into mailbox 100 through hole 112 in the bottom 110 can not directly contact any mail stored within the lower portion of mailbox 100. In the preferred embodiment, a raised solid platform 140 is used.

As indicated by arrows 138, rotating platform 114 is free to rotate about axle 116 until stopped by inwardly protruding lip 128 of front door 118. It will be recognized that a vandal could apply a rotative force to indicator lever 124 and possibly break one or more components of mailbox 100. Consequently, it is preferable to join rotating platform to axel 116 through a torque limiting mechanism, not shown. Such a torque limiting mechanism would allow axel 116 to turn relative to rotating platform 114 without damage to any mailbox 100 component while maintaining structural integrity of the box and security for any mail contained therein.

A clip 134 which holds outgoing mail is attached to a first surface of rotating platform 114. Clip 134 is affixed to a surface of rotating platform 114 such that clip 134 faces downward into an interior region of mailbox 100 toward closed end 110. Rotating platform 114 rests on an upper surface of inwardly protruding lip 128.

A mailbox lid or cover 136 covers the open top of mailbox 100. Lid 136 is attached to rear surface 104 of mailbox 100 by a hinge 142.

Figure 4:
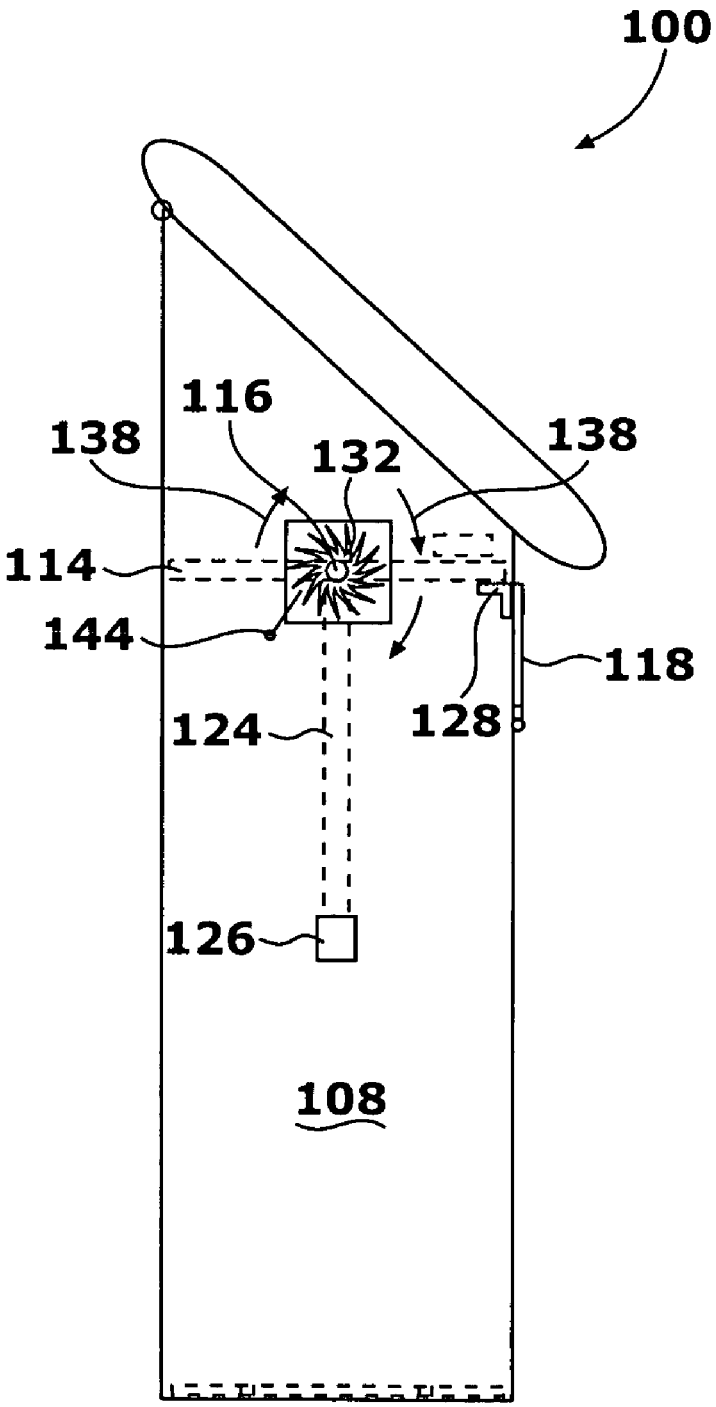
FIG. 4 is a left side, elevational view of the mailbox of FIG. 1.

Referring now to FIG. 4, there is shown a left elevational view of mailbox 100. Ratchet gear 132 is affixed to axle 116 within the interior of mailbox 100 and adjacent an inner surface of left side 108. A pawl 144, interacting with ratchet gear 132, limits rotation of axle 116 to the clockwise direction as viewed from the left side of mailbox 100 and indicated by arrows 138. Indicator arm 124 and sliding sleeve 126 are attached to a protruding end of axle 116.

Figure 5A:
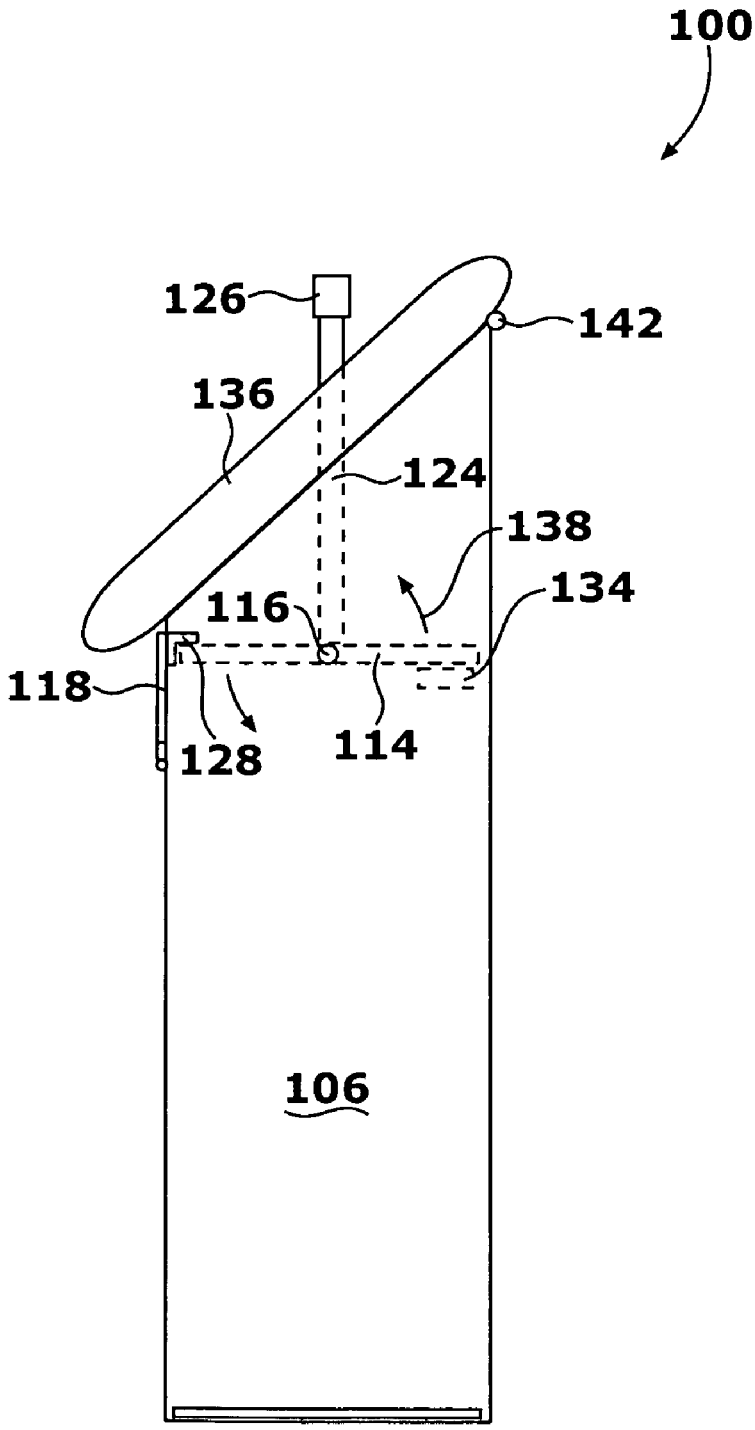
FIGS. 5*a*–5*d* are right side, elevational views showing an operating sequence of the mailbox of FIG. 1.

Referring now to FIGS. 5*a*–5*d*, there is shown a series of right side, elevational views indicating the sequence of operations performed when secure mailbox 100 is used. In operation, it is assumed that mailbox 100 is left in an unlocked, ready state in anticipation of mail delivery, as shown in FIG. 5*a*. It may be seen that a front edge of rotating platform 114 is positioned under inwardly protruding lip 128. When the mail carrier (not shown) arrives, lid 136 is opened in anticipation of placing mail 146 (FIG. 5*b*) into mailbox 100.

Figure 5B:
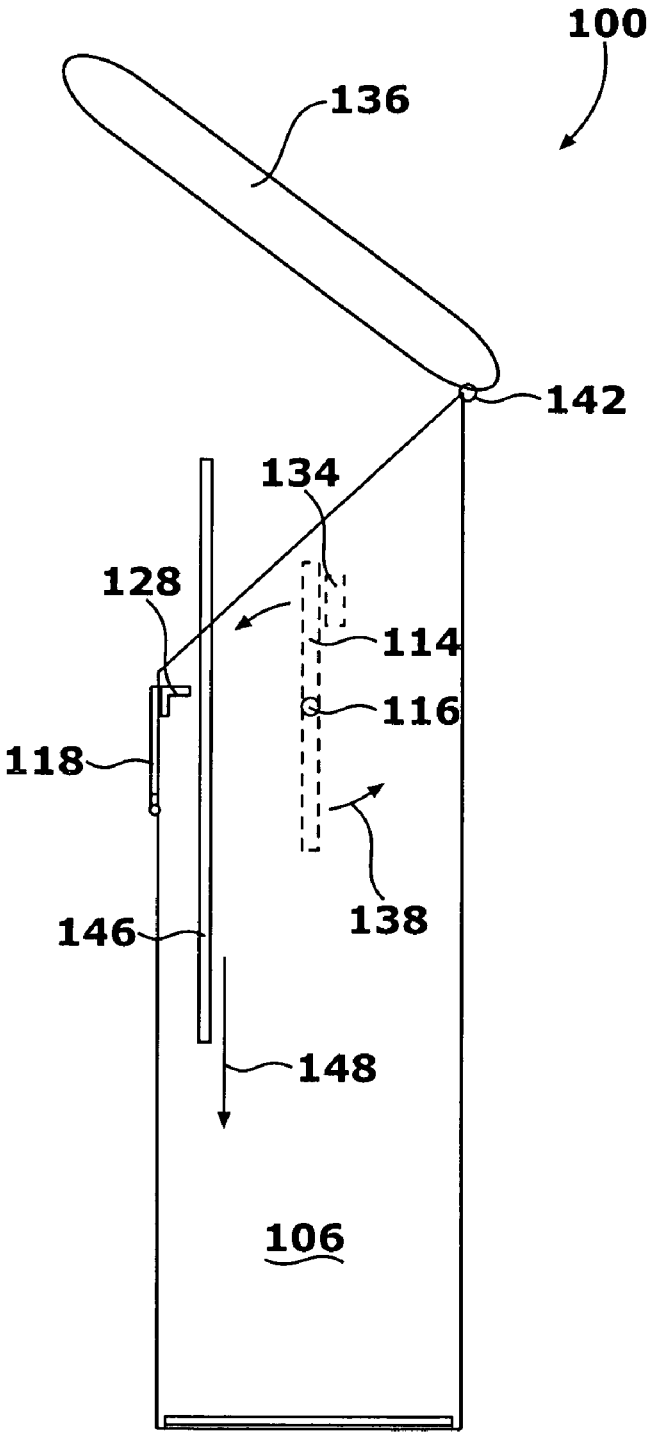

Referring now to FIG. 5*b*, mail 146 is placed in mailbox 100 by dropping mail 146 downward from the open top in a direction indicated by arrow 148. By pressing mail 146 against rotating platform 114, rotating platform is moved to a substantially vertical position, thereby allowing mail 146 to pass and drop into the interior of mailbox 100.

Figure 5C:
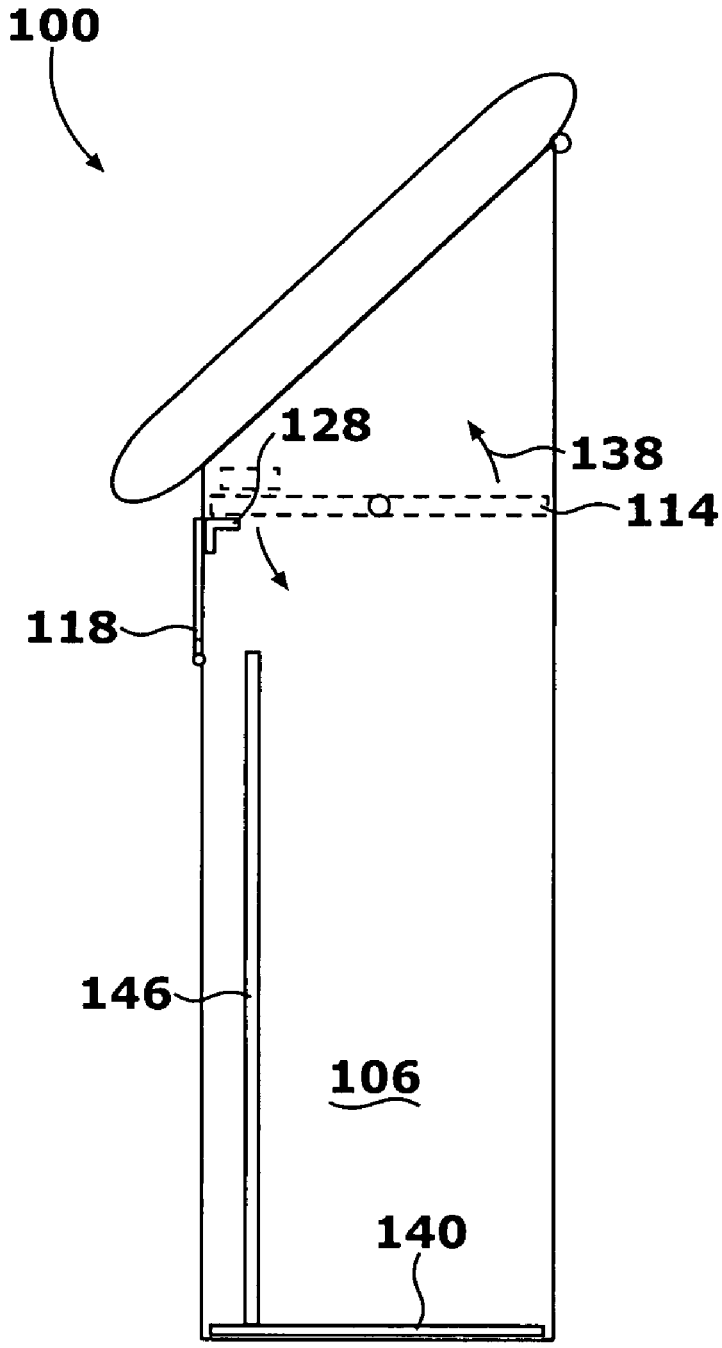

As mail 146 passes rotating platform 114, the mail carrier continues to rotate platform 114 in a counter-clockwise direction, when viewed from the right side, as indicated by arrows 138 until an edge thereof rests on the upper surface of inwardly protruding lip 128. At this point, the rotation of platform 114 is arrested. This state is shown in FIG. 5*c*. Mail 146 rests on an upper surface of raised mesh platform 140. Rotating platform 114 may no longer rotate as it is constrained by an upper surface of inwardly protruding lip 128. Ratchet gear 132 in combination with pawl 144 (FIG. 4) prevents rotating platform 114 from rotating in a clockwise direction. Consequently, mail 146, once deposited in mailbox 100, may not be removed by simply moving platform 114. Once rotating platform 114 is retained against an upper surface of inwardly protruding lip 128, any outgoing mail, not shown, placed in the mailbox 100 and held by mail retaining clip 134 is easily removed by the mail carrier.

Figure 5D:
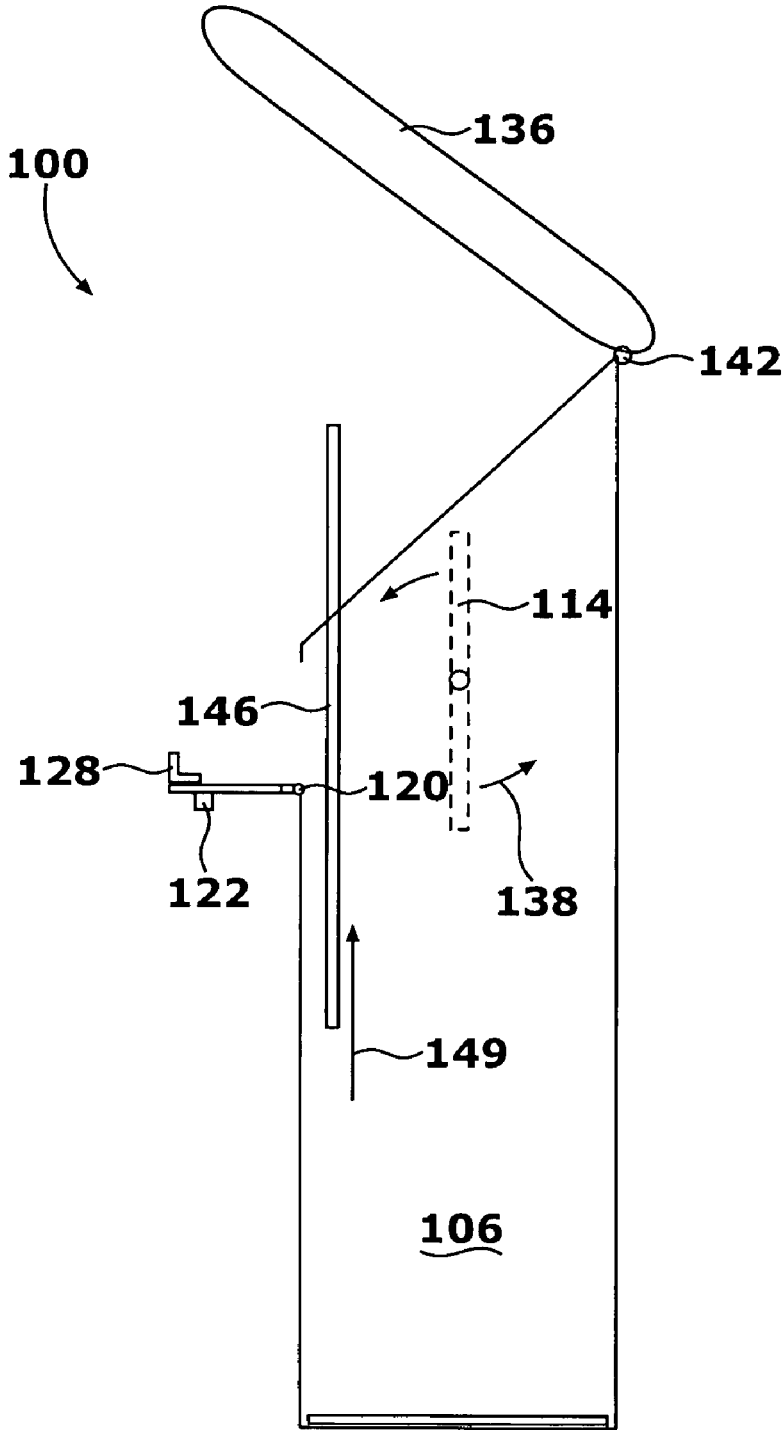

Mail 146 is removed from mailbox 100 as shown in FIG. 5*d*. When lock 122 is unlocked, front door 118 may be opened by rotating front door 118 forward, thereby withdrawing inwardly protruding lip 128 and thus allowing rotating platform 114 to again rotate in a counter-clockwise direction as indicted by arrows 138. As rotating platform 114 again reaches a substantially vertical position, mail 146 may readily be withdrawn from mailbox 100 through the top opening. Once front door 118 is again closed and secured by lock 122, mailbox 100 is returned to the state shown in FIG. 5*a* and is again ready to accept mail.

If outgoing mail is to be placed in mailbox 100, this may be accomplished before front door 118 is closed and locked. When outgoing mail is present, sliding sleeve 126 is moved to a position on indicator arm 124 so as to signal the mail carrier that mail is present.

In alternate embodiments, an optional coil or similar spring, not shown, may be used to bias rotating platform 114, thereby urging its continued counter-clockwise rotation.

The inventive mailbox configuration provides security to delivered mail without imposing undue constraints on the mail carrier by requiring extra effort on his or her part during mail delivery. In addition, because the mailbox must be "reset" after each mail delivery, if a mail carrier unexpectedly finds a mailbox into which mail can not be placed, this fact may be reported to a supervisor and follow-up with the mail patron may be undertaken. If an elderly or otherwise infirm patron has fallen or for other reasons has been unable to come to the mailbox, an appropriate care agency may be notified for follow up.

It is possible that a subscription monitoring program could be implemented wherein a barcode, not shown, on the inside of the cover (or elsewhere accessible to the mail carrier) may be scanned and the fact that a particular mailbox was unexpectedly found in a locked configuration automatically reported via e-mail, the internet, etc. to a relative or friend of the postal patron. In this way, the friend or relative may be notified of a potential problem with the postal patron (i.e., they are bed ridden, have fallen, or any other condition that may have prevented their retrieving mail and resetting the mailbox.

Likewise, if a mail patron is on vacation and has asked for a hold on mail, then mailbox 100 may be left in a locked configuration; neither the original mail carrier nor a substitute mail carrier can inadvertently deliver mail.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A security mailbox, comprising:

a) a hollow, substantially rectangular box having two spaced apart, substantially parallel left and right sides, a front and a rear surface, a closed bottom and an open top;

b) an axle disposed transversely within said hollow, rectangular box proximate said open top, substantially parallel to said closed bottom and substantially perpendicular to the major plane of both said front and said rear surface of said hollow, rectangular box;

c) a thin, planar, rotating platform rigidly affixed to said axle, and sized and configured to substantially close a cross section of said hollow, rectangular box when said platform is parallel to said closed bottom and in a closed position and to substantially open said cross section when said platform is disposed substantially perpendicular to said closed bottom;

d) means for limiting rotation of said axle and said thin, planar, rotating platform to a single direction; and e) means for limiting rotation of said axle and said thin planar rotating platform to approximately a single revolution when said platform rotates from a ready mail receiving position to said closed position.

2. The security mailbox as recited in claim 1, further comprising:

f) a front door disposed in and hingedly affixed to said front surface and selectively movable between a closed and an open position.

3. The security mailbox as recited in claim 2, wherein said means for limiting rotation of said axle and said rotating platform to approximately a single revolution comprises an inwardly protruding lip disposed adjacent a top of said front door.

4. The security mailbox as recited in claim 3, wherein said front door comprises means for facilitating locking thereof in said closed position.

5. The security mailbox as recited in claim 3, wherein said thin, planar rotating platform comprises means for retaining outgoing mail affixed to a surface thereof, said means for retaining facing downwardly into an interior region of said mailbox when said thin, planar rotating platform rests on an upper surface of said lip.

6. The security mailbox as recited in claim 1, wherein said means for limiting rotation to a single direction comprises a ratchet gear and a pawl.

7. The security mailbox as recited in claim 6, wherein said ratchet gear is disposed on said axle inside said hollow box adjacent one of said left side and said right side thereof.

8. The security mailbox as recited in claim 1, further comprising:

f) a lid, hingedly affixed to said hollow, rectangular box adjacent said open top and adapted to selectively open and close said open top.

9. The security mailbox as recited in claim 1, further comprising:

f) means for supporting deposited mail above said closed door.

10. The security mailbox as recited in claim 9, wherein said means for supporting deposited mail comprises a raised mesh platform.

11. The security mailbox as recited in claim 9, wherein said closed bottom comprises at least one hole adapted to drain moisture from an interior region of said hollow box.

12. The security mailbox as recited in claim 1, further comprising:

f) an indicator disposed adjacent and exterior one of said right and said left sides of said hollow box and rigidly affixed to an end of said axle, being adapted to rotate therewith.

13. The security mailbox as recited in claim 12, wherein said indicator comprises an elongated structure having a surrounding, sliding sleeve selectively movable along said elongated structure.

14. A security mailbox, comprising:

a) a hollow, substantially rectangular box having a front surface, a rear surface, a left side, a right side, a closed bottom and an open top, said closed bottom comprising at least one hole therein adapted to drain moisture from an interior region of said substantially rectangular, hollow box;

b) an axle disposed transversely within said hollow, rectangular box proximate said open top and substantially parallel to said closed bottom and to both said front and said rear surface of said hollow, rectangular box;

c) a thin, planar, rotating platform rigidly affixed to said axle, and sized and configured to substantially close a cross section of said hollow, rectangular box when parallel to said closed bottom and substantially open said cross section when disposed substantially perpendicular to said closed bottom;

d) a front door disposed in and hingedly affixed to said front surface and selectively movable between a closed and an open position, said front door comprising locking means for securing said front door in said closed position, said front door comprising an inwardly protruding lip disposed adjacent a top of said front door for limiting rotation of said axle and said platform to approximately a single revolution;

e) a ratchet gear and pawl for limiting rotation of said axle and said platform to a single direction, said ratchet gear being disposed on said axle and inside said box adjacent one of said left side and said right side thereof;

f) a lid, hingedly affixed to said hollow, rectangular box adjacent said open top thereof and adapted to selectively cover and uncover said open top;

g) a raised mesh platform adjacent said closed bottom for supporting deposited mail thereabove; and h) an elongated indicator disposed adjacent and exterior to one of said right side and said left side, rigidly affixed to an end of said axle and adapted to rotate therewith, said elongated indicator having a sliding sleeve selectively movable along said elongated indicator.

15. A method of using a security mailbox, the steps comprising:

a) providing said security mailbox selectively changeable between an open, mail accepting configuration and a locked, mail retaining configuration, said security mailbox comprising a closed, hollow receptacle having a rotating platform constrained to rotate in a single direction and for only a single revolution per cycle, said security mailbox comprising a locked front door for releasing said rotating platform and allowing a change from said open, mail accepting configuration to said locked, mail retaining configuration;

b) setting said security mailbox in said open, mail accepting configuration;

c) receiving mail in said security mailbox and changing said open, mail accepting configuration to said closed, mail retaining configuration;

d) unlocking said mailbox and withdrawing retained mail therefrom; and e) repeating steps (b) through (d).

* * * * *